US005263442A

United States Patent [19]

Hara

[11] Patent Number: 5,263,442

[45] Date of Patent: Nov. 23, 1993

[54] VALVE TIMING CONTROL APPARATUS

[75] Inventor: Seinosuke Hara, Kanagawa, Japan

[73] Assignee: Atsugi Unisia Corporation, Atsugi, Japan

[21] Appl. No.: 920,851

[22] Filed: Jul. 28, 1992

[30] Foreign Application Priority Data

Jul. 31, 1991 [JP] Japan ..... 3-191760

[51] Int. Cl.[5] ..... F01L 1/34

[52] U.S. Cl. ..... 123/90.17; 123/90.31; 464/2; 464/160; 74/568 R

[58] Field of Search ..... 123/90.12, 90.13, 90.15, 123/90.17, 90.31; 74/568 R, 567; 464/1, 2, 160

[56] References Cited

U.S. PATENT DOCUMENTS

| | | | |
|---|---|---|---|
| 4,231,330 | 11/1980 | Garcea | 123/90.15 |
| 4,787,345 | 11/1988 | Thoma | 123/90.15 |
| 4,856,465 | 8/1989 | Denz et al. | 123/90.15 |
| 4,858,572 | 8/1989 | Shirai et al. | 123/90.31 |
| 4,862,843 | 9/1989 | Kawamoto | 123/90.17 |
| 4,895,113 | 1/1990 | Speier et al. | 123/90.17 |
| 4,903,650 | 2/1990 | Ohlendorf et al. | 123/90.17 |
| 5,088,456 | 2/1992 | Suga | 123/90.17 |
| 5,111,780 | 5/1992 | Hannibal | 123/90.17 |
| 5,138,985 | 8/1992 | Szodfridt et al. | 123/90.31 |

*Primary Examiner*—Willis R. Wolfe
*Assistant Examiner*—Weilun Lo
*Attorney, Agent, or Firm*—Foley & Lardner

[57] ABSTRACT

A valve timing control apparatus including a rotary member drivingly connected to an engine crankshaft for rotation with the engine crankshaft, and a drive mechanism for transmitting rotation of the rotary member to a camshaft. The drive mechanism includes a piston member provided for reciprocation between first and second positions within the rotary member to rotate the camshaft with respect to the rotary member. The piston member defines first and second pressure chambers on the opposite sides thereof along with the rotary member. A valve member is provided for movement between third and fourth positions. The valve member is adapted to connect the first pressure chamber to a pressure source while connecting the second pressure chamber to a drain port to produce a pressure differential between the first and second pressure chambers to move the piston member toward the second position when the valve member moves from the third position to the fourth position. The valve member is adapted to connect the first pressure chamber to the drain port while connecting the second pressure chamber to the pressure source to produce a pressure differential between the first and second chambers so as to move the piston member toward the first position when the valve member moves from the fourth position to the third position. The valve member is moved according to engine operating conditions.

2 Claims, 5 Drawing Sheets

VALVE TIMING CONTROL APPARATUS

BACKGROUND OF THE INVENTION

This invention relates to a valve timing control apparatus for use in an internal combustion engine to provide a desired valve timing(s) according to engine operating conditions.

For example, U.S. Pat. No. 4,231,330 discloses a valve timing control apparatus for controlling the intake or exhaust valve timing according to engine operating conditions. The valve timing control apparatus employs a cylindrical gear having internal and external threaded portions one of which is taken in the form of a helical gear. The external threaded portion engages with the inner threaded portion of a rotary drum which is formed on its outer peripheral surface with sprocket teeth for engagement with a timing chain engaging with a sprocket mounted on the crankshaft of the engine. The internal threaded portion of the cylindrical gear engages with the external threaded portion formed on the camshaft of the engine. A return spring is provided to urge the cylindrical gear to rotate the camshaft with respect to the rotary drum in a direction retarding the valve timing. The valve timing is advanced by introducing a fluid pressure into a pressure chamber formed on one side of the cylindrical gear to move the cylindrical gear against the resilient force of the return spring.

With such a conventional valve timing control apparatus, however, the valve timing control is made merely in an ON-OFF manner between two valve timing values.

SUMMARY OF THE INVENTION

It is a main object of the invention to provide an improved valve timing control apparatus which has a stepless valve timing control to change the timing of closure of intake or exhaust valves to a desired value.

There is provided, in accordance with the invention, a valve timing control apparatus for use in an internal combustion engine having a crankshaft driven by the engine and a camshaft adapted to drive at least one valve. The valve timing control apparatus comprises a rotary member drivingly connected to the crankshaft for rotation with rotation of the crankshaft, and a drive mechanism for transmitting rotation of the rotary member to the camshaft. The drive mechanism includes a piston member provided for reciprocation between first and second positions within the rotary member to rotate the camshaft with respect to the rotary member. The piston member has means for rotating the camshaft at a maximum angle with respect to the rotary member in a first direction when the piston member is at the first position and at a maximum angle with respect to the rotary member in a second direction opposite to the first direction when the piston member is at the second position. The piston member defines first and second pressure chambers on the opposite sides thereof along with the rotary member. The valve timing control apparatus also includes a valve member movable between third and fourth positions. The valve member includes means for connecting the first pressure chamber to a pressure source while connecting the second pressure chamber to a drain port to produce a pressure differential between the first and second pressure chambers to move the piston member toward the second position when the valve member moves from the third position to the fourth position. The valve member also includes means for connecting the first pressure chamber to the drain port while connecting the second pressure chamber to the pressure source to produce a pressure differential between the first and second chambers so as to move the piston member toward the first position when the valve member moves from the fourth position to the third position. A control means is provided for moving the valve member according to engine operating conditions.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
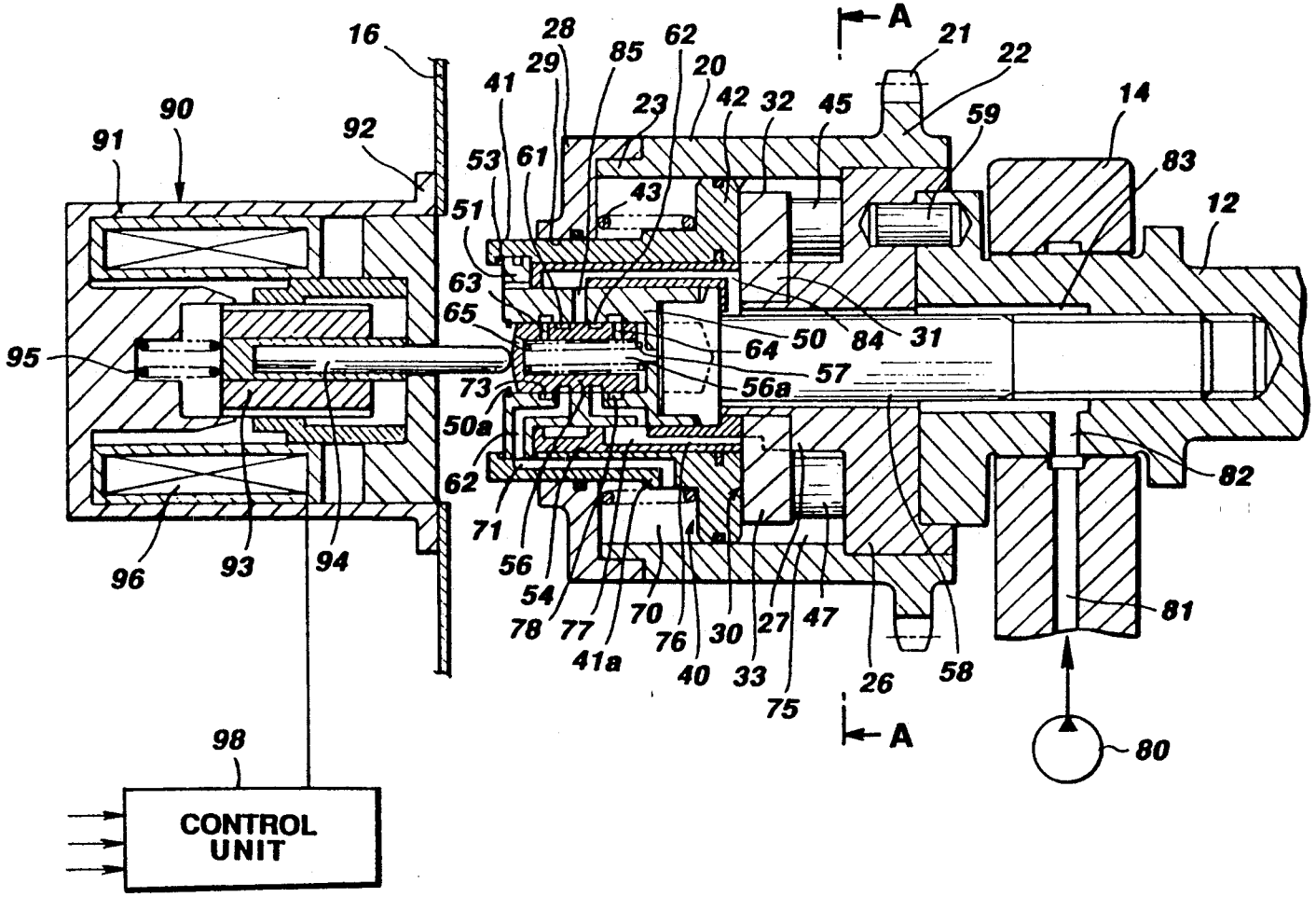
FIG. 1 is a longitudinal sectional view showing one embodiment of a valve timing control apparatus made in accordance with the invention.
Figure 2:
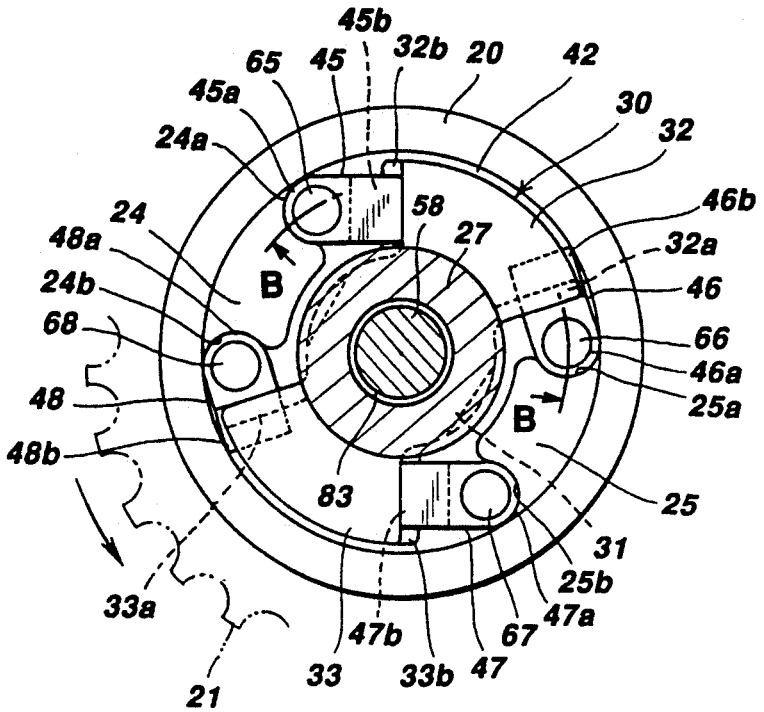
FIG. 2 is a transverse sectional view of the valve timing control apparatus as viewed through lines A-A of FIG. 1.

With reference to the drawings and in particular to FIGS. 1 and 2, there is shown a valve timing control apparatus embodying the invention. The valve timing control apparatus includes a rotary drum 20 formed on its outer peripheral surface with sprocket teeth 21 for engagement with a timing chain (not shown). The timing chain engages with a drive sprocket mounted on the engine crankshaft (not shown) for transmitting rotation of the engine crankshaft to rotate the rotary drum 20 at half the speed of the engine crankshaft. The rotary drum 20 has a front end portion 22 rotatably fitted around a cylindrical support member 26 and a rear end portion 23 closed by a circular end cover 28 having a circular center hole 29.

Figure 3:
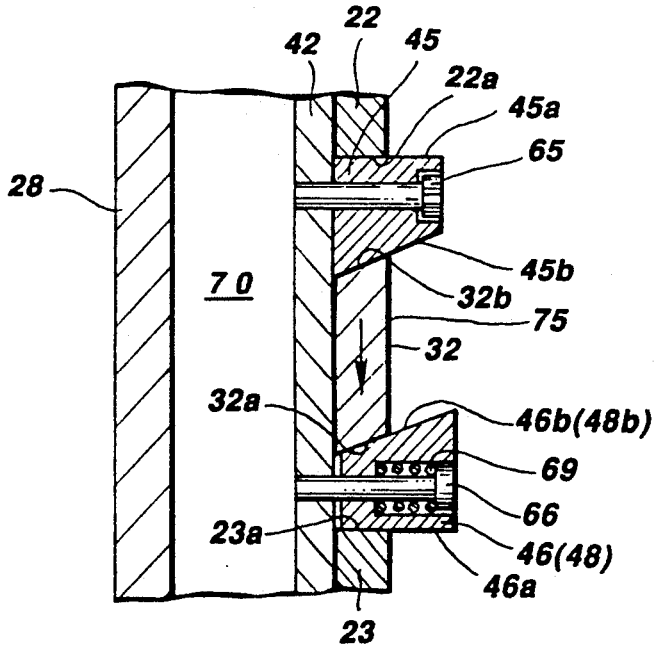
FIG. 3 is a fragmentary sectional view of the valve timing control apparatus as viewed through lines B-B of FIG. 2.

The rotary drum 20 is formed on its inner peripheral surface with a pair of inwardly extending projections 24 and 25 facing each other. The support member 26 has a stepped rear portion 27 to which an arm member 30 is fixed for rotation in unison therewith. The arm member 30 has an internally threaded center root portion 31 threadably engaged with the externally threaded rear portion 27 of the support member 26 and a pair of sector wing portions 32 and 33 extending outwardly radially from the center root portion 31. The sector wing portions 32 and 33 lie substantially in the same plane as the projections 24 and 25. The sector wing portion 32 has first and second side surfaces **32*a* and 32*b* inclined in the same direction, as best shown in FIG. 3, and a semi-circular end surface facing the inner peripheral surface of the rotary drum 20. Similarly, the sector wing portion 33 has first and second side surfaces 33*a* and 33*b* inclined in the same direction, as best shown in FIG. 3, and a circular end surface facing the inner peripheral surface of the rotary drum 20. In FIG. 3, the arrow indicates the direction of rotation of the rotary drum 20**.

The rotary drum 20 contains a piston member 40 placed for sliding movement within the rotary drum 20. The piston member 40 has a cylindrical rear portion 41 extending through the center hole 29 of the end cover 28 and an annular front flange portion 42 held in sliding contact with the inner peripheral surface of the rotary drum 20. The cylindrical rear portion 41 has a shoulder 41*a* which comes into abutment against the center hole 29 of the end cover 28 to limit the movement of the piston member 40 in the leftward direction, as viewed in FIG. 1. A coil spring 43 is provided between the end cover 28 and the annular front flange portion 42 to urge the piston member 40 in the rightward direction, as viewed in FIG. 1. The piston member 40 contains a cylindrical inner member 50 which is formed at its rear end with an annular flange 51 fitted in an annular groove formed near the rear end of the cylindrical rear portion 41 of the piston member 40. A snap spring 53 is placed in the annular groove to secure the annular flange 51 of the cylindrical inner member 50 to the cylindrical rear portion 41 of the piston member 40. A cylindrical intermediate member 54 is placed for axial sliding movement within an annular space defined between the cylindrical rear portion 41 of the piston member 40 and the cylindrical inner member 50. A valve member 56 is placed for sliding movement within the cylindrical inner member 50. The valve member 56 has a cylindrical wall closed at its rear end by an end wall to define an oil chamber 56*a* therein. A coil spring 57 is placed in the oil chamber 56*a* to urge the valve member 56 against a snap ring 50*a* fixed near the rear end of the cylindrical inner member 50.

In the illustrated case, the valve timing control apparatus is applied to a DOHC type internal combustion engine including a camshaft 12 which is supported by a bearing 14 for rotation to drive unshown cams so as to open and close the respective intake valves of the engine. The bearing 14 forms a part of the cylinder head of the engine. The camshaft 12, the support member 26 and the cylindrical intermediate member 54 are fixed for rotation in unison therewith by means of a bolt 58 extending axially through the support member 26 into the camshaft 12. A knock pin 59 extends partially into the camshaft 12 and partially into the support member 26 to position the camshaft 12 with respect to the support member 26.

The piston member 40 has four cam members 45, 46, 47 and 48 rotatably mounted on the front end surface thereof and equally spaced circumferentially. The cam member 45, which is secured rotatably to the annular flange portion 42 of the piston member 40 by means of a pin 65, projects between the projection 24 and the sector wing portion 32. The cam member 45 has a circular cam surface 45*a* held in surface contact with the circular side surface 24*a* of the projection 24 and an inclined cam surface 45*b* held in surface contact with the inclined side surface 32*b* of the sector wing portion 32 of the arm member 30. The cam member 46, which is secured rotatably to the annular flange portion 42 of the piston member 40 by means of a pin 66, projects between the projection 25 and the sector wing portion 32. A spring 69 is provided to urge the cam member 46 toward the piston member 40 so as to retain the inclined side surface 32*b* of the sector wing portion 32 in pressure surface contact with the inclined side surface 45*b* of the cam member 45, as best shown in FIG. 3. The cam member 46 has a circular cam surface 46*a* held in surface contact with the circular side surface 23*a* of the projection 23 and an inclined cam surface 46*b* held in surface contact with the inclined side surface 32*a* of the sector wing portion 32 of the arm member 30. The cam member 47, which is secured rotatably to the annular flange portion 42 of the piston member 40 by means of a pin 67, projects between the projection 25 and the sector wing portion 33. The cam member 47 has a circular cam surface 47*a* held in surface contact with the circular side surface 25*b* of the projection 25 and an inclined cam surface 47*b* held in surface contact with the inclined side surface 33*b* of the sector wing portion 33 of the arm member 30. The cam member 48, which is secured rotatably to the annular flange portion 42 of the piston member 40 by means of a pin 68, projects between the projection 24 and the sector wing portion 33. The cam member 48 has a circular cam surface 48*a* held in surface contact with the circular side surface 24*b* of the projection 24 and an inclined cam surface 48*b* held in surface contact with the inclined side surface 33*a* of the sector wing portion 33 of the arm member 30. A spring is provided to urge the cam member 48 toward the piston member 40 so as to retain the inclined side surface 33*b* of the sector wing portion 33 in pressure surface contact with the inclined side surface 47*b* of the cam member 47. The inclined cam surfaces 45*b* and 47*b* push the corresponding side surfaces 32*b* and 33*b* of the sector wing portions 32 and 33 to rotate the support member 26 and thus the camshaft 12 with respect to the rotary drum 20 in the same direction as the direction of rotation of the rotary drum 20 so as to advance the timing of closure of the intake valves when the piston member 40 moves in the leftward direction, as viewed in FIG. 1. The cam surfaces 46*b* and 48*b* push the corresponding side surfaces 32*a* and 33*a* of the sector wing portions 32 and 33 to rotate the support member 26 and thus the camshaft 12 with respect to the rotary drum 20 in the direction opposite to the direction of rotation of the rotary drum 20 so as to retard the timing of closure of the intake valves when the piston member 40 moves in the rightward direction, as viewed in FIG. 1.

The valve member 56 has first and second annular grooves 61 and 62 formed, in spaced-parallel relation to each other, in the outer peripheral surface thereof. Radial conduits 63 and 64 extend through the cylindrical wall of the valve member 56 into the oil chamber 56*a* on the opposite sides of the first and second annular grooves 61 and 62. A drain conduit 65 extends through the end wall of the valve member 56 into the oil chamber 56*a*.

A first pressure chamber 70 is defined between the end cover 28 and the annular flange portion 42 of the piston member 40. The first pressure chamber 70 is connected through a conduit 71 formed in the cylindrical rear portion 41 of the piston member 40 and a conduit 72 formed in the cylindrical inner member 50 for connection to the first annular groove 61 formed in the outer peripheral surface of the valve member 56. An annular groove 73 is formed in the inner peripheral surface of the cylindrical inner member 50 for connection to the radial conduit 63. A second pressure chamber 75 is defined between the support member 26 and the annular flange portion 42 of the piston member 40. The second pressure chamber 75 is connected through a conduit 76 formed in the cylindrical intermediate member 54 and a conduit 77 formed in the cylindrical inner member 50 for connection to the second annular groove 62 formed in the outer peripheral surface of the valve member 56. An annular groove 78 is formed in the inner peripheral surface of the cylindrical inner member 50 for connection to the radial conduit 64.

An oil pump 80 is connected to a conduit 81 formed in the cylinder head 14. The conduit 81 is connected through an annular groove to a radial conduit 82 formed in the camshaft 12. The radial conduit 82 is connected to an annular conduit 83 defined partially between the bolt 58 and the camshaft 12 and partially between the bolt 58 and the support member 26. The annular conduit 83 is connected to a conduit 84 formed in the cylindrical intermediate member 54. The conduit 84 is connected to a radial conduit 85 for connection to the first or second annular groove 61 or 62 formed in the outer peripheral surface of the valve member 56.

An actuator 90 is provided for advancing the valve member 56 to the right, as viewed in FIG.1, and retracting it to the left, as viewed in FIG. 1. The actuator 90 includes a housing 91 having an annular flange 92 bolted to the chain cover 16. The housing 91 contains a core 93 for reciprocal sliding movement toward and away from the valve member 56. The core 93 carries an operation plunger 94 fixed thereto for movement in unison therewith. A coil spring 95 is placed in the housing 91 to urge the core 93 to retain the tip end of the operation plunger 94 in pressure contact with the rear wall of the valve member 56. The housing 91 also contains a solenoid 96 which moves the core 93 in response to a command current signal fed thereto from a control unit 98. The control unit 98 may employ a digital computer to calculates a desirable value for the command current signal to the solenoid 96 based upon existing engine operating conditions including engine crankshaft position, engine speed, throttle valve position, engine coolant temperature, engine intake airflow, etc. The actuator 90 may be of the proportional solenoid type where the distance of movement of the operation plunger 94 is in direct proportion with the magnitude of the command current signal fed to the solenoid 96 from the control unit 98.

Figure 4:
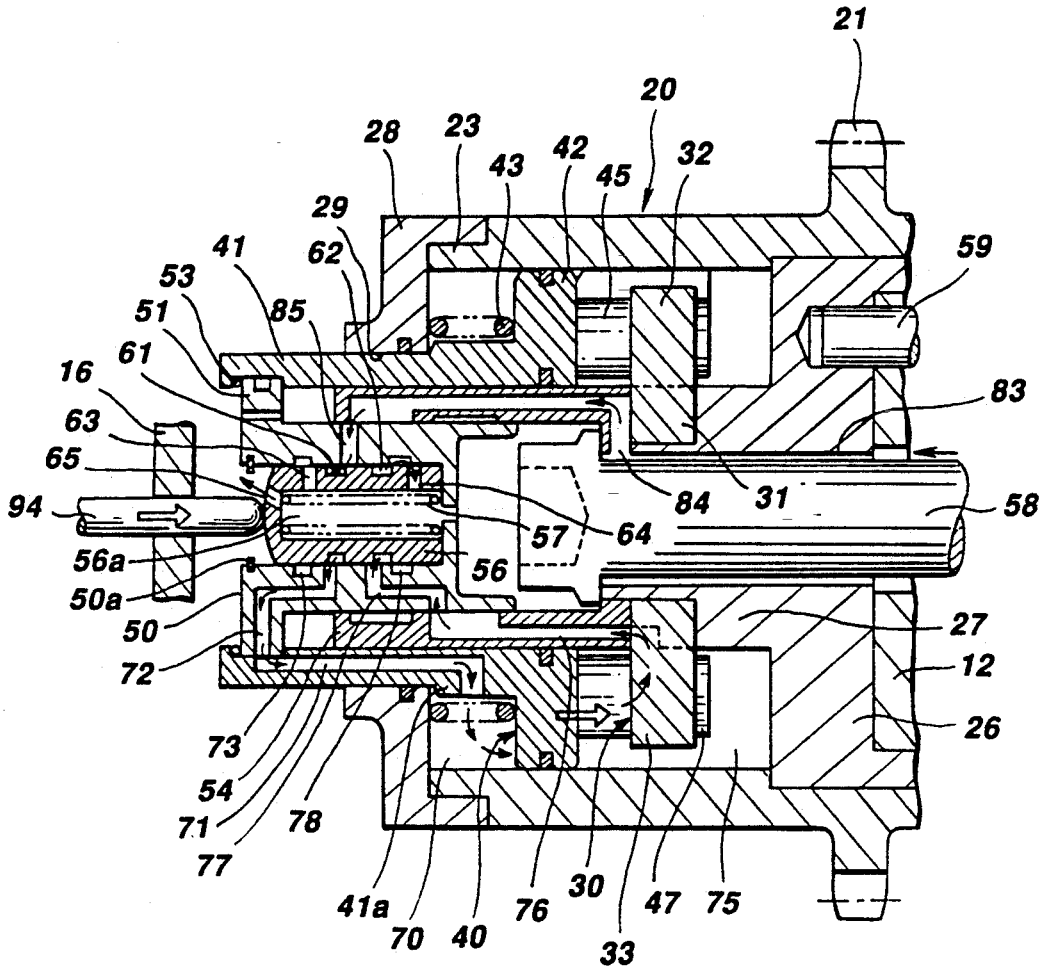
FIGS. 4 and 5 are enlarged fragmentary longitudinal sectional views used in explaining the operation of the valve timing control apparatus of the invention.

The operation of the valve timing control apparatus of the invention will be described. When the engine is operating at a low-speed low-load condition or a high-speed high-load condition, the command current signal fed from the control unit 98 has a maximum value causing the solenoid 96 to extrude the operation plunger 94 at a maximum distance so as to push the valve member 56 in the rightward direction, as viewed in FIG. 1, against the resilient force of the coil spring 57. In the course of the rightward movement of the valve member 56, the first annular groove 61 comes into connection with the radial conduit 85 while both of the second annular groove 62 and the radial conduit 64 come into connection with the annular groove 78, as shown in FIG. 4. As a result, the valve timing control apparatus introduces a fluid pressure into the first pressure chamber 70 from the oil pump 80 through the conduits 81, 82, 83, 84, 85, 61, 72 and 71 while discharging the fluid pressure from the second pressure chamber 75 through conduits 76, 77, 62, 78 and 64 into the oil chamber **56*a* and hence through the drain conduit 65 to the exterior so as to produce a pressure differential across the opposite sides of the annular front flange portion 42 of the piston member 40. This pressure differential causes the piston member 40 to move toward its rightmost position with the inclined cam surfaces 46*b* and 48*b* pushing the corresponding side surfaces 32*a* and 33*a* of the respective sector wing portions 32 and 33 so as to rotate the support member 26 and thus the camshaft 12 with respect to the rotary drum 20 in the direction opposite to the direction of rotation of the rotary drum 20. At the rightmost position, as shown in FIG. 1, the camshaft 12 is rotated at a greatest angle with respect to the rotary drum 20 in a direction retarding the timing of closure of the intake valves. With the rightward movement of the piston member 40, the cylindrical intermediate member 54 moves in the leftward direction with respect to the piston member 40. When the piston member 40 arrives at its rightmost position, the radial conduit 85 comes out of connection with both of the first and second annular grooves 61 and 62 and it is closed by the outer peripheral portion of the valve member 56 between the first and second annular grooves 61 and 62. As a result, the first and second pressure chambers 70 and 75 are closed to maintain the pressure differential across the annular front flange portion 42 of the piston member 40 so as to retain the piston member 40** at the rightmost position.

Figure 5:
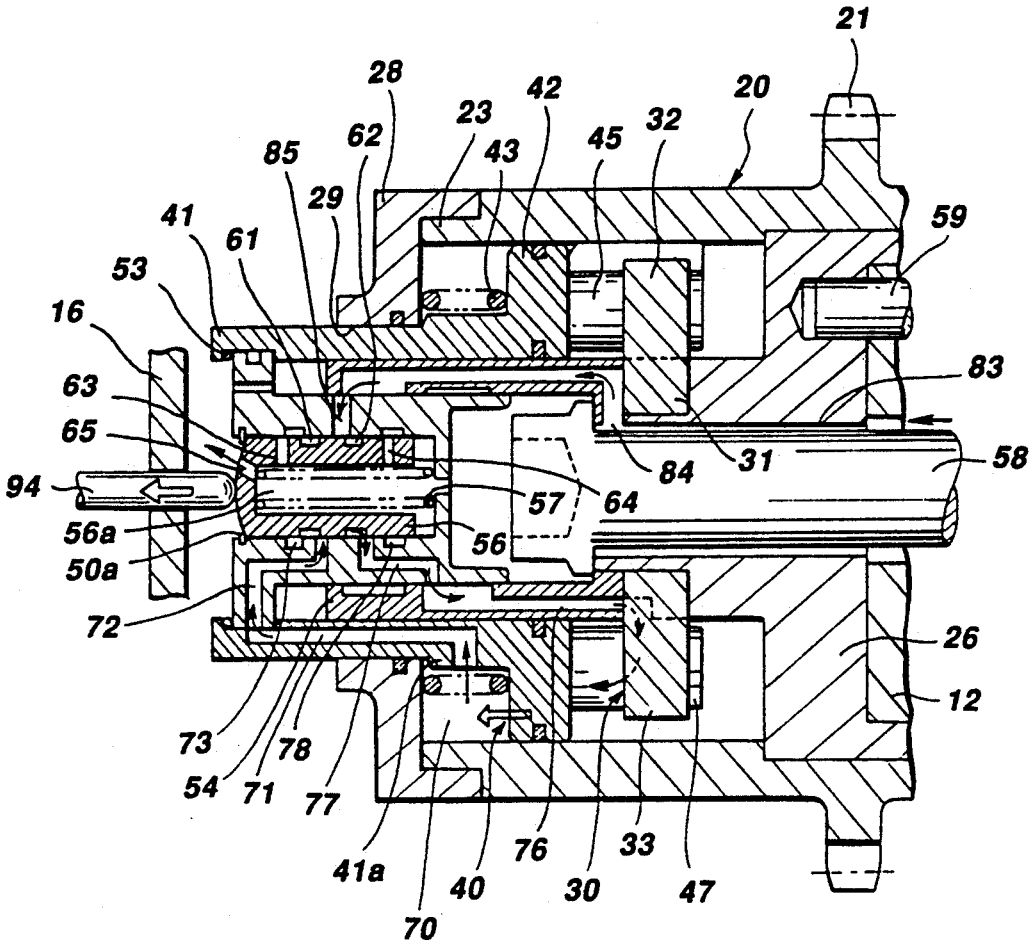
Figure 6:
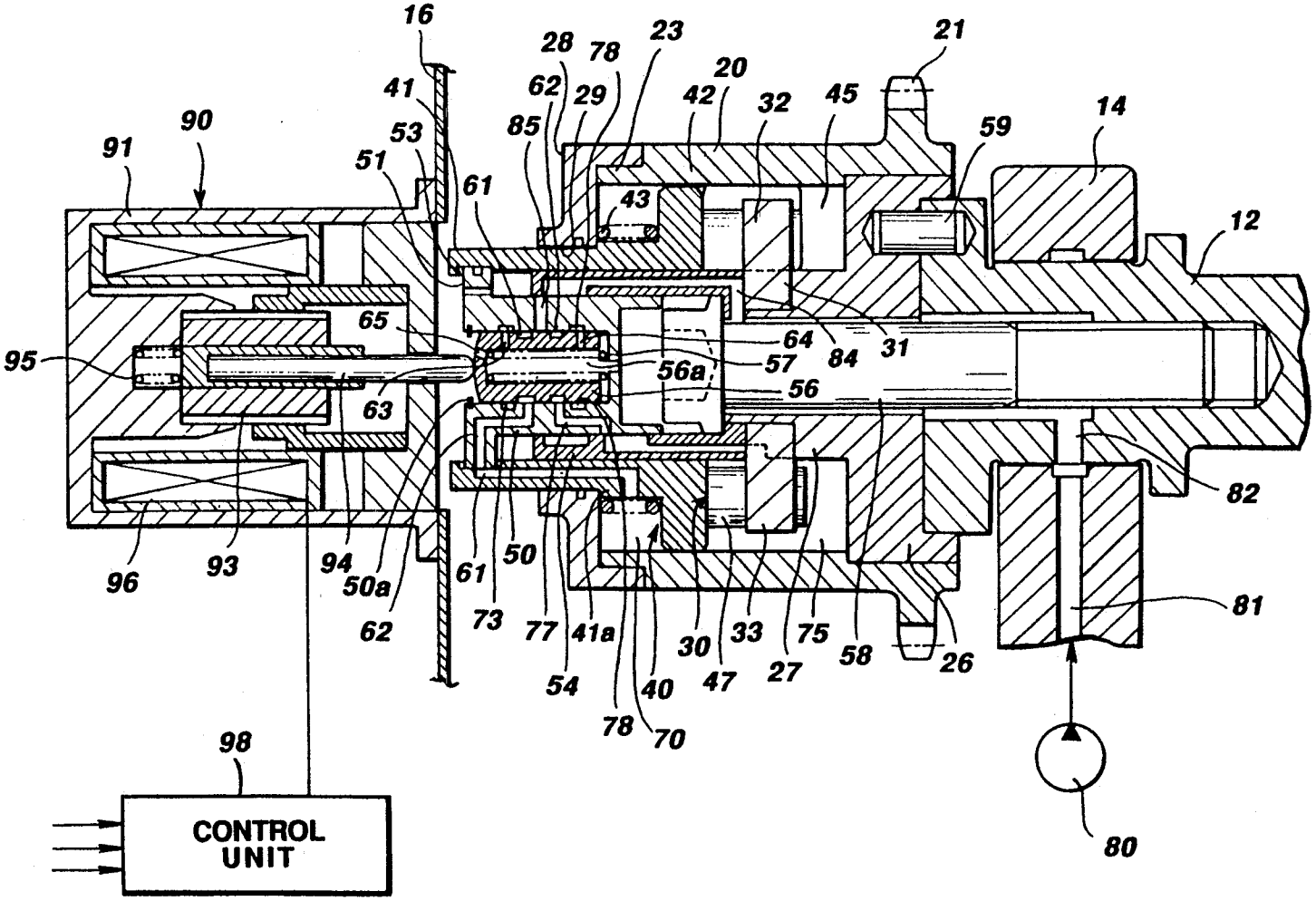
FIG. 6 is a longitudinal sectional view showing the valve timing control apparatus of the invention with the piston member at its leftmost position.

When the engine is operating at a low-speed high-load condition or an intermediate-speed intermediate-load condition, the control unit 98 interrupts the command current signal to the solenoid 96 of the actuator 90. As a result, the valve member 56 moves in the leftward direction under the resilient force of the coil spring 57 to retract the operation plunger 94 against the resilient force of the coil spring 95. In the course of the leftward movement of the valve member 56, the second annular groove 62 comes into connection with the radial conduit 85 while both of the first annular groove 61 and the radial conduit 63 come into connection with the annular groove 73, as shown in FIG. 5. As a result, the valve timing control apparatus introduces a fluid pressure into the second pressure chamber 70 from the oil pump 80 through the conduits 81, 82, 83, 84, 85, 62, 77 and 76 while discharging the fluid pressure from the first pressure chamber 70 through conduits 71, 72, 61, 73 and 63 into the oil chamber **56*a* and hence through the drain conduit 65 to the exterior so as to produce a pressure differential across the opposite sides of the annular front flange portion 42 of the piston member 40. This pressure differential causes the piston member 40 to move toward its leftmost position with the inclined cam surfaces 45*b* and 47*b* pushing the corresponding side surfaces 32*b* and 33*b* of the respective sector wing portions 32 and 33 so as to rotate the support member 26 and thus the camshaft 12 with respect to the rotary drum 20 in the same direction as the direction of rotation of the rotary drum 20. At the leftmost position, as shown in FIG. 6, the camshaft 12 is rotated at a greatest angle with respect to the rotary drum 20 in a direction advancing the timing of closure of the intake valves. With the leftward movement of the piston member 40, the cylindrical intermediate member 54 moves in the rightward direction with respect to the piston member 40. When the piston member 40 arrives at its leftmost position, the radial conduit 85 comes out of connection with both of the first and second annular grooves 61 and 62 and it is closed by the outer peripheral portion of the valve member 56 between the first and second annular grooves 61 and 62. As a result, the first and second pressure chambers 70 and 75 are closed to maintain the pressure differential across the annular front flange portion 42 of the piston member 40 so as to retain the piston member 40** at the leftmost position.

The control unit 98 controls the magnitude of the command current signal to the solenoid 96 of the actuator 90 to move the valve member 56 at a desired position between its leftmost and rightmost positions according to the existing engine operating conditions. It is, therefore, possible to control the timing of closure of the intake valves in a stepless manner according to engine operating conditions.

While the invention has been described in connection with intake valve timing control, it is to be understood that the invention is equally applicable to control the exhaust valve timing. While the invention has been described in conjunction with a specific embodiment thereof, it is evident that many alternatives, modifications and variations will be apparent to those skilled in the art. Accordingly, it is intended to embrace all alternatives, modifications and variations that fall within the scope of the appended claims.

What is claimed is:

1. A valve timing control apparatus for use in an internal combustion engine having a crankshaft driven by the engine and a camshaft adapted to drive at least one valve, the valve timing control apparatus comprising;

a rotary valve member drivingly connected to the crankshaft for rotation with the crankshaft;

a drive mechanism for transmitting rotation of the rotary member to the camshaft, the drive mechanism including a piston member provided for reciprocation between first and second positions within the rotary member to rotate the camshaft with respect to the rotary member, the piston member having means for rotating the camshaft at a maximum angle with respect to the rotary member in a first direction when the piston member is at the first position and at a maximum angle with respect to the rotary member in a second direction opposite to the first direction when the piston member is at the second position, the piston member defining first and second pressure chambers on the opposite sides thereof along with the rotary member;

a valve member movable between third and fourth positions, the valve member including means for connecting the first pressure chamber to a pressure source while connecting the second pressure chamber to a drain port to produce a pressure differential between the first and second pressure chambers to move the piston member toward the second position when the valve member moves from the third position to the fourth position, the valve member including means for connecting the first pressure chamber to the drain port while connecting the second pressure chamber to the pressure source to produce a pressure differential between the first and second chambers so as to move the piston member toward the first position when the valve member moves from the fourth position to the third position, the valve member including means for closing the first and second pressure chambers to retain the piston member at the first position when the piston member is at the first position, and means for closing the first and second pressure chambers to retain the piston member at the second position when the piston member is at the second position; and control means for moving the valve member according to engine operating conditions.

2. The valve timing control apparatus as claimed in claim 1, wherein the control means includes means for moving the valve member at a distance calculated as a function of engine operating conditions.

* * * * *